US006392515B1

(12) United States Patent
Van Zeeland et al.

(10) Patent No.: US 6,392,515 B1
(45) Date of Patent: May 21, 2002

(54) MAGNETIC SWITCH WITH MULTI-WIDE ACTUATOR

(75) Inventors: Anthony J. Van Zeeland, Mesa, AZ (US); Michael Anthony Van Zeeland, Venice, CA (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 09/748,457

(22) Filed: Dec. 27, 2000

(51) Int. Cl.[7] ..... H01H 9/00
(52) U.S. Cl. ..... 335/205
(58) Field of Search ..... 335/205, 208

(56) References Cited

U.S. PATENT DOCUMENTS 3,167,624 A * 1/1965 Jones, Jr. ..... 335/205
4,513,271 A * 4/1985 Reisem ..... 335/205
5,977,888 A * 11/1999 Fujita et al. ..... 341/34
5,990,772 A * 11/1999 Van Zeeland ..... 335/207

* cited by examiner

*Primary Examiner*—Ramon M. Barrera
(74) *Attorney, Agent, or Firm*—Cook, Alex, McFarron, Manzo, Cummings & Mehler, Ltd.

(57) ABSTRACT

A magnetically actuated switch has a magnet coupler layer spaced from a set of electrodes formed on a substrate. The electrodes include spaced contacts. The coupler layer normally holds a conductive armature spaced from the contacts. An aperture in the coupler layer provides access to the armature for application of an actuating force by an actuator. The actuator has a base portion mounted on the coupler layer and a force-receiving portion cantilevered from the base portion. The actuator has a width greater than that of the armature. Alternately, the armature itself can include a base portion pivotable on the substrate and a multi-wide force-receiving portion cantilevered from the base portion.

15 Claims, 3 Drawing Sheets

Fig.4.
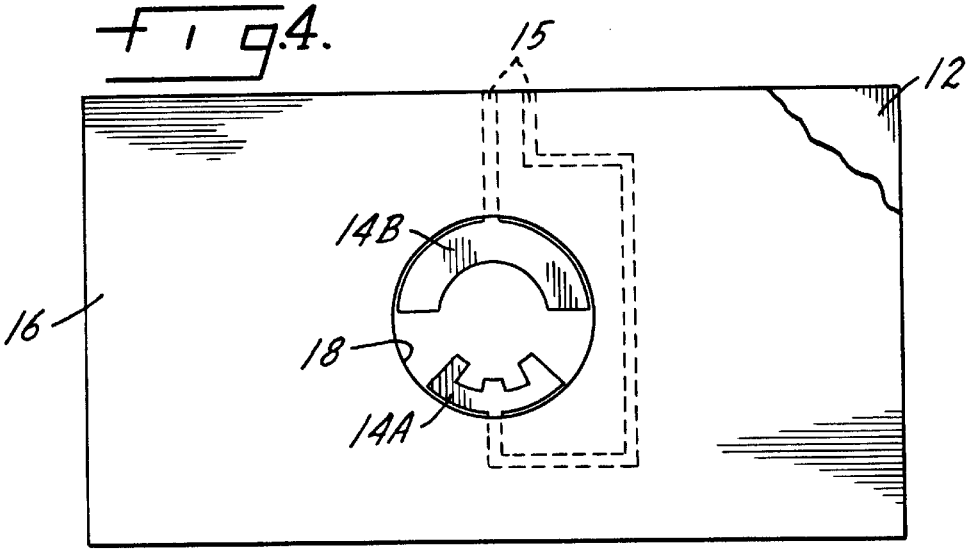
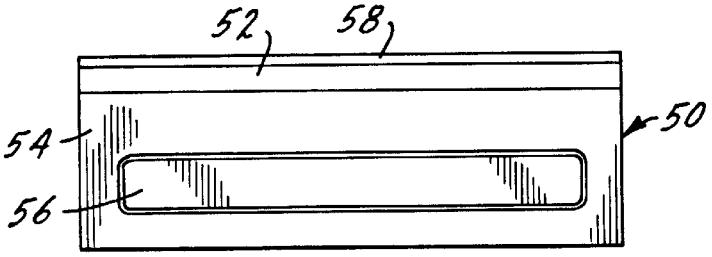
Fig.6.
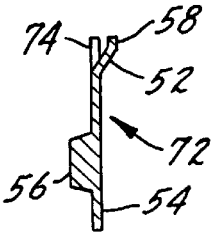
Fig.9.
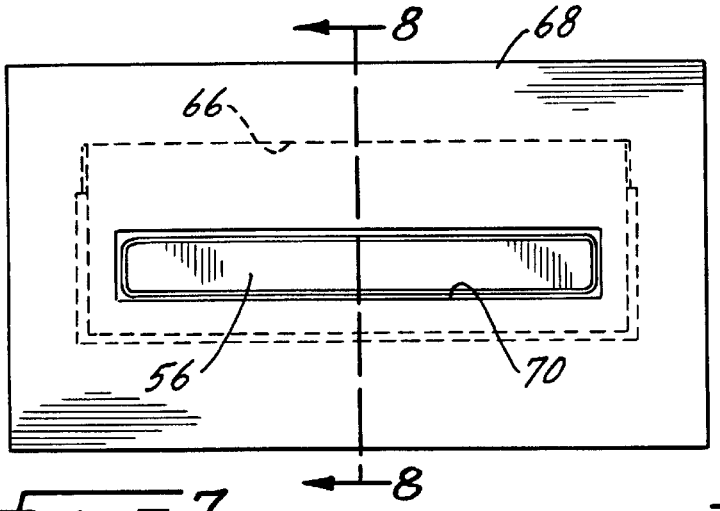
Fig.7.
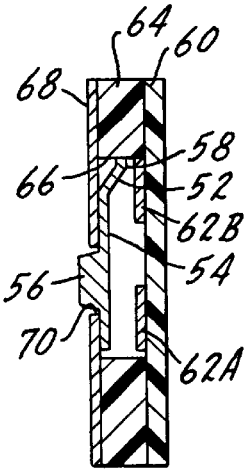
Fig.8.

MAGNETIC SWITCH WITH MULTI-WIDE ACTUATOR

BACKGROUND OF THE INVENTION

Magnetically actuated switches provide a compact, reliable and durable switching function. These switches offer a very slim profile, low weight and economical assembly and are used in an increasing number of applications in a variety of environments. They combine the tactile feel of a bulky mechanical switch with the compactness of a conventional membrane switch. Magnetically actuated switches of this general type are shown and described in U.S. Pat. Nos. 5,523,730, 5,666,096 and 5,867,082, the disclosures of which are incorporated herein by reference.

While magnetically actuated switches already have many applications, it is advantageous to expand the applications of such switches even further. For instance, it would be desirable to have magnetically actuated switches that can be adapted to any size or width while maintaining switch reliability. Sometimes switches require keys or activating surfaces that are large or wide compared to the force-applying member that actuates them. Common examples are the spacebar and shift and enter keys of a standard keyboard. Vending machines often have selection switches that are wider than users' fingers or group of fingers. Machine controls commonly have large switches that are plainly visible and convenient because they do not require a precisely-located actuating force; hitting the cap or button anywhere on its surface will work. Switches of this nature, especially in the keyboard field, are sometimes referred to as multi-wide switches. Multi-wide switches have key caps, buttons or like activating members that are wide or large compared to either the underlying electrical contacts or a user's fingers. The difficulty with multi-wide switches is transferring the actuating force from the key cap or button to the electrical contacts which may be substantially remote from the center of the actuating force. The moments generated by the offset actuating force can cause binding of the movable elements of the switch. Various arrangements are known for effecting smooth, non-binding movement of multi-wide actuators in standard electromechanical switches and in keyboards. These may include torsion bars, guide sleeves and the like. However, these solutions are typically not usable in magnetically actuated switches because magnetically actuated switches do not have the space available for such devices. While conventional devices may be adaptable to magnetically actuated switches, doing so would defeat one of the primary benefits of magnetically actuated switches, namely, their compact size. The present invention provides compact, reliable multi-wide actuators for magnetically actuated switches.

SUMMARY OF THE INVENTION

The present invention relates to magnetically actuated switches and is particularly concerned with a switch having a multi-wide actuator.

In one embodiment the switch of the present invention includes a substrate having a set of electrodes on the upper surface thereof. The electrodes include at least one pair of spaced contacts or pads. Electrical leads suitably connect the contacts to external electronics. The pads are arranged so that a conductive armature is movable into and out of engagement with the pads. Engagement of the armature with the pads will short them and cause switch closure. The armature is normally held in spaced relation to the contacts or pads by a coupler layer. The coupler layer is mounted above the surface of the substrate having the contacts or pads by a spacer. The spacer has an opening through it that surrounds the contacts. The armature is disposed in the opening. An aperture in the coupler layer is located above the armature so that an actuating force can be applied to the armature through the aperture. The coupler layer is a magnet. The armature is made of magnetic material. By magnetic material it is meant that the material is affected by a magnet. Conversely, non-magnetic material is material that is not affected by a magnet. The magnetic attraction between the coupler layer and the armature normally holds the armature spaced from the contacts or pads. An actuating force applied to the armature causes it to break away from the coupler layer with a crisp, tactile snap and move into engagement with the contacts, thereby closing the switch. In the present invention the actuating force is applied to the armature by an actuator. The actuator is typically a non-magnetic sheet overlying the aperture in the coupler layer. The actuator is engageable with the armature through the aperture. The actuator includes a force-receiving portion and a base portion. The base portion is always in contact with the coupler layer. The force-receiving portion is cantilevered from the base portion. When the switch is in its normal, unactuated condition the force-receiving portion is spaced from the coupler layer. The actuator may have a size that is large compared to the armature, to the contacts and to the size of a user's finger. Application of actuating force to the force-receiving portion of the actuator causes it to pivot about the base portion. The actuator is sufficiently stiff such that regardless of where the actuating force is applied to the force-receiving portion, that force will be transferred to the armature, causing it to break free of the coupler layer and move into engagement with the contacts.

Another embodiment of the present invention has a substrate, contacts and a coupler layer similar to those described above. A multi-wide armature is used having a base portion and a force-receiving portion. The base portion always remains in contact with the substrate. The force receiving-portion is movable into and out of engagement with the contacts, and with the coupler layer. The force-receiving portion is exposed to an actuating force either by placing it beyond an edge of the coupler layer or in line with an aperture in the coupler layer. Application of actuating force to the force-receiving portion causes the armature to pivot about the base portion, carrying the force-receiving portion into engagement with the contacts. Removal of the actuating force allows the magnetic attraction of the coupler layer and armature to pull the force-receiving portion of the armature up and away from the contacts, thereby opening the switch.

BRIEF DESCRIPTION OF THE DRAWINGS

FIG. 4 is a plan view of the lower spacer, looking in the direction of line 4—4 of FIG. 2, with a portion cut away.

FIG. 6 is a top plan view of an armature of a further alternate form of the invention.

FIG. 7 is a top plan view a switch incorporating the armature of FIG. 6.

FIG. 8 is a section taken along line 8—8 of FIG. 7.

FIG. 9 is a section through an alternate form of armature.

DETAILED DESCRIPTION OF THE INVENTION

Figure 1:
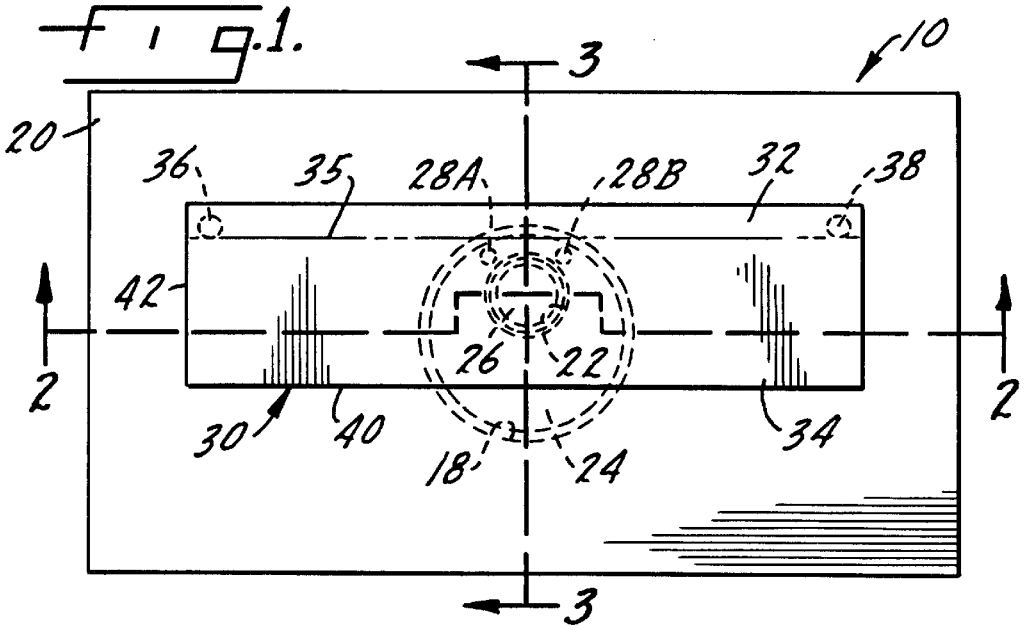
FIG. 1 is a top plan view of a pushbutton switch of the present invention.

FIGS. 1–4 illustrate a basic form of the switch 10 according to the present invention. The switch includes a substrate 12 made of a suitable non-conductive material. The substrate may be either rigid or flexible, depending on the environment in which the switch will be used. Printed circuit board material or polyester are examples of acceptable substrate materials. A set of electrodes is formed on at least one surface of the substrate. The electrodes are made of conductive materials that may be painted, printed, etched or otherwise formed on the substrate. The electrodes include at least one pair of spaced contacts or pads as best seen at 14A and 14B in FIG. 4. It will be understood that the electrodes include leads 15 connected to the contacts. The leads 15 extend to a suitable connector, typically at an edge of the substrate, for connection to external electronics. The external electronics supply the electrical signals on the leads 15 and contacts 14A, 14B that are switched by shorting the contacts together. The particular arrangement of the electrodes shown is for illustrative purposes only. The electrodes can be arranged in a wide variety of configurations, according to the needs of a particular application. Also, the thickness of the electrodes shown throughout the various figures is exaggerated somewhat for clarity.

A lower spacer 16 lies adjacent the substrate 12. The lower spacer is made of non-conductive material and may be attached to the substrate by adhesive and/or mechanical means. The lower spacer has an opening 18 in the area of the contacts 14A, 14B. The lower spacer 16 supports a coupler layer 20 spaced from the substrate 12. Preferably the coupler layer is a magnet. It has an aperture 22 aligned with the area of the opening 18.

An armature 24 is disposed generally underneath the coupler layer 20 and in the spacer opening 18. The armature is electrically conductive and made of magnetic material. Accordingly, it is normally held in the position shown in the drawings. The armature has a button 26 that protrudes upwardly through the coupler layer's aperture 22. There are also two small fulcrums 28A and 28B on the underside of the armature. The armature defines a primary dimension. In this embodiment the armature is circular so the primary dimension is its diameter. The armature could have other shapes, such as rectangular or triangular, in which the primary dimension might be, say, the long leg of the rectangle or the height of the triangle. Also, while it is preferred that the coupler layer is a magnet and the armature is made of magnetic material, it will be understood that this could be reversed so the armature would be a magnet and the coupler layer would be made of magnetic material.

Figure 2:
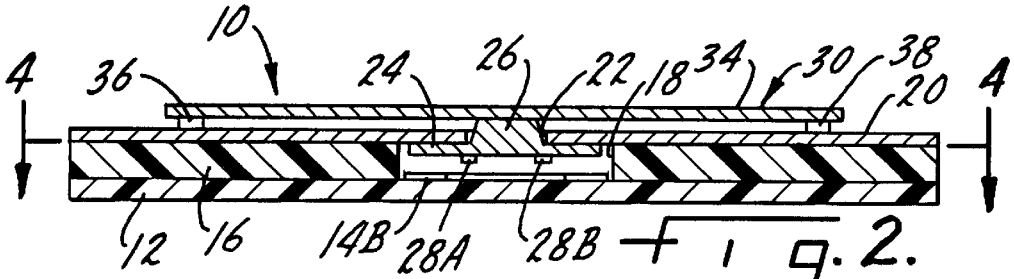
FIG. 2 is a section taken along line 2—2 of FIG. 1.
Figure 3:
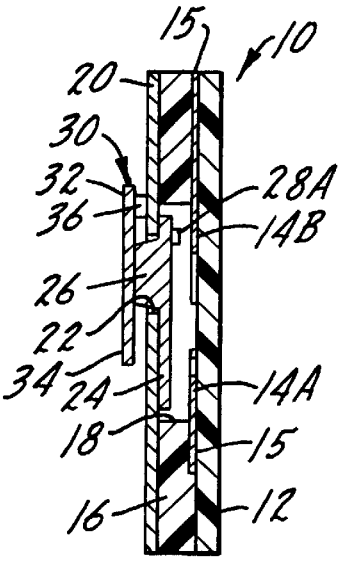
FIG. 3 is a section taken along line 3—3 of FIG. 1.

The switch 10 is completed by an actuator 30. The actuator is made of a rigid, non-magnetic material such as stainless steel. It has a base portion 32 and a force-receiving portion 34. These two areas of the actuator are separated by an imaginary line indicated at 35. The force-receiving portion 34 is cantilevered from the base portion 32. The base portion includes a pair of standoffs 36 and 38 located at adjacent corners of the actuator. In this embodiment the actuator is generally rectangular and has long edges 40 and short edges 42. The centers of the standoffs 36 and 38 define a line parallel to one of the long edges. The standoffs elevate the force-receiving portion 34 from the coupler layer 20 as can be seen in FIGS. 2 and 3.

It can be seen that the force-receiving portion 34 of the actuator 30 is large or multi-wide. There are several ways to look at what is meant by this. One way is by comparison with the primary dimension of the armature 24. By way of reference and not limitation, a typical diameter of an armature is about three quarters of an inch. If the standoffs 36 and 38 are separated from one another by a distance greater than the primary dimension, in this case the diameter, of the armature then the actuator may be considered to be large. Another way to determine if an actuator is large or multi-wide is to consider the area of the expected actuating member. In many instances the expected actuating member will be a user's fingertip. A normal human fingertip might have an area of about one quarter square inch. If the area of the force-receiving portion is significantly greater than this, say about twice the area of the fingertip, then the actuator is large or multi-wide. This gives the user a target area for actuating the switch that does not have to precisely match the location of the armature.

The use, operation and function of the switch of FIGS. 1–4 are as follows. The switch components are normally held in the condition shown in the drawings. Thus, the coupler layer's magnetic force on the armature 24 holds the armature against the underside of the coupler layer 20, spaced from the contacts 14A and 14B and the switch is open. When a user exerts an actuating force anywhere on the force-receiving portion 34 of the actuator 30, the force-receiving portion pivots about the base portion 32. The resulting downward force on the button 26 of the armature 24 causes a portion of the armature to break free from the coupler layer. First, the edge of the armature nearest the fulcrums 28A, 28B breaks away and moves into engagement with contact 14B. Then the armature pivots about the fulcrums on contact 14B and the remainder of the armature comes into engagement with contact 14A. This closes the switch. When the actuating pressure is removed, the magnetic force pulls the armature 24 back up, off the contacts 14A and 14B and opens the switch. The returning armature button 26 pushes the actuator 30 back to its normal condition as shown in the drawings.

Figure 5:
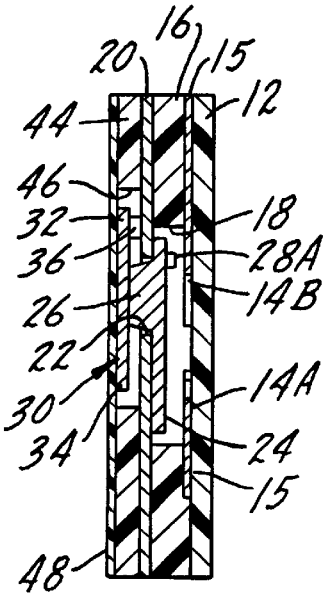
FIG. 5 is a section, similar to FIG. 3, of an alternate embodiment.

FIG. 5 illustrates an alternate embodiment of the switch of FIGS. 1–4. This version adds to the FIG. 1 switch an upper spacer 44 having an opening 46 in the area of the actuator 30. A flexible overlay 48 is attached to the top of the upper spacer 44. The remaining components are the same as in the previous embodiment and their description will not be repeated. The overlay 48 is made of flexible material such as polyester. It may have suitable graphics indicating the location of the actuator 30, as well as the function of the switch. The upper spacer and overlay may be adhesively attached to one another and to the coupler layer to seal the underlying components from contaminants.

FIGS. 6–8 illustrate another form of a switch with a multi-wide actuating surface. In this case the actuating surface is part of an enlarged armature which is shown generally at 50 in FIG. 6. The armature 50 includes a base portion 52 and a force-receiving portion 54. The force-receiving portion 54 is cantilevered from the base portion 52. An elongated, upraised button 56 is included in the force-receiving portion 52. Beyond the button is a nose portion 57. The base portion 52 includes a foot 58 that is in contact with the substrate. When the switch is in its normal, unactuated condition the force-receiving portion 54 is spaced from the substrate and contacts. The armature is made of electrically conductive, magnetic material.

FIGS. 7 and 8 show the assembled switch components. In addition to the armature 50 these components include a substrate 60 having a set of electrodes on one surface thereof. The electrodes include at least one pair of spaced contacts or pads 62A and 62B. Suitable leads (not shown) extend from the pads to a connector for external electronics. A non-conductive spacer 64 lies adjacent the substrate 60. The spacer has a wide opening 66 that receives the armature 50. Above the spacer and at least-partially extending over the opening 66 is a coupler layer 68. The coupler layer is a sheet magnet. The coupler layer has a cutout 70 aligned with the spacer opening 66.

Figure 10:
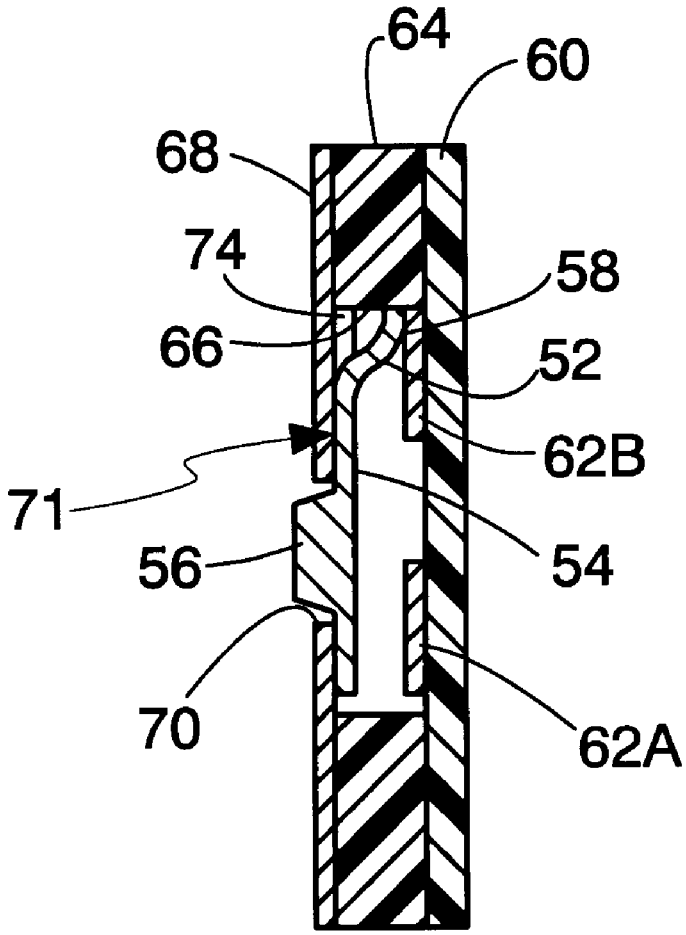
FIG. 10 is a section, similar to FIG. 8, of an alternative embodiment.

While FIG. 8 shows a gap of several thousandths of an inch between the foot 58 and the top of the electrode 62B, an alternate construction of an armature 71, as shown in FIG. 10 with like parts shown with like number, extends the foot 58 into full time engagement with the electrode. In that situation the electrodes, including the contacts and leads, obviously are arranged to avoid shorting engagement with the foot 58 of the armature, i.e, the foot does not engage the other contact 62A or the lead for it. A further alternate would be to replace some of the coupler layer with a polyester sheet. In this arrangement the coupler layer would extend over the opening 66 to a point adjacent the button 56 of armature 50. On the other side of the button there would be a cover sheet that rests on the spacer 64 and extends partially over the spacer opening 66. The cover sheet would have a cutout area for receiving the button 56. The structure of FIGS. 7 and 8 might also be supplemented with an upper spacer and flexible overlay similar to those shown in FIG. 5. The upper spacer would have an opening aligned with the armature button 56. The overlay would seal the switch against entry of contaminants. A double pole switch could be made by placing a third contact or pad underneath the nose portion 57 of the armature. It would have its own lead, of course, and would be shorted to pad 62A by the nose when the switch is actuated.

The switch of FIGS. 7 and 8 operates as follows. The magnetic attraction between the armature 50 and the coupler layer 68 normally holds the switch in the condition shown in the drawings. The force-receiving portion 54 engages the underside of the coupler layer 68, holding the force-receiving portion spaced above the contacts. The foot 58 in the illustrated embodiment is slightly spaced from the contact 62B. A user can actuate the switch by applying pressure anywhere on the force-receiving portion 54 of the armature 50. As a practical matter the force will usually be applied to the upraised button 56 because this is the part protruding upwardly through the coupler layer 68. The user can press anywhere on the button and thereby cause the foot 58 to move into engagement with contact 62B and thereafter the armature 50 will pivot about the foot 58. This moves the force-receiving portion into engagement with the contact 62A, shorting the contacts 62A and 62B and closing the switch. Release of the actuating pressure allows the magnetic attraction between the coupler layer and the armature to return the armature to the normal, open position shown in the drawings.

FIG. 9 illustrates an alternate form of an armature 72 for use in the switch of the type shown in FIGS. 7 and 8. Armature 72 is similar to armature 50 but adds a shoulder 74 to the base portion of the armature. The shoulder engages the underside of the coupler layer 68 to add further stability to the pivoting motion of the armature. As shown in FIG. 10, the shoulder 74 always remains in contact with the coupler layer 68.

While a preferred form of the invention has been shown and described, it will be realized that alterations and modifications may be made thereto without departing from the scope of the following claims. For example, other armature and actuating button shapes including but not limited to round, oval, triangular, square and any combination thereof could be used. Other variations in the armature button are also possible. For example, the armature may have multiple raised punches or actuating buttons on its face. Or the button could be formed on the actuator instead of on the armature. In the multi-wide armature form, the base portion does not necessarily have to extend the full width of the force-receiving portion. There could be two separate legs or offsets at the corners only of the force-receiving portion.

What is claimed is:

1. An electrical switch, comprising:

a substrate;

a set of electrodes disposed on said substrate and defining at least one pair of spaced switch contacts;

a coupler layer supported in spaced relation to the substrate;

an electrically conductive armature disposed between the coupler layer and the switch contacts, one of the coupler layer and armature being a permanent magnet and the other being made of magnetic material such that the armature is normally held spaced from the switch contacts in engagement with said coupler layer by the magnetic attraction between the coupler layer and armature;

an aperture in the coupler layer, with the armature being disposed with respect to the aperture such that an actuating force exerted through the aperture will act on the armature; and an actuator overlying the aperture and engageable with the armature through said aperture, the actuator including a force-receiving portion and a base portion, the base portion being in contact with the coupler layer, the force-receiving portion being cantilevered from the base portion and spaced from the coupler layer when in an unactuated condition.

2. The switch of claim 1 further characterized in that the switch is suitable for actuation by a user-controlled force-applying member having a predetermined surface of a known area for engaging the switch and wherein the force-receiving portion has an area that is large compared to said known area of the force-applying member.

3. The switch of claim 1 wherein the force-receiving portion of the actuator is a sheet of non-magnetic material.

4. The switch of claim 1 further comprising a lower spacer between the substrate and coupler layer, the lower spacer having at least one opening in which the armature is disposed.

5. The switch of claim 4 further comprising an upper spacer adjacent the coupler layer, the upper spacer having at least one opening in which the actuator is disposed.

6. The switch of claim 5 further comprising a flexible overlay sheet adjacent the upper spacer.

7. The switch of claim 1 further comprising an upper spacer adjacent the coupler layer, the upper spacer having at least one opening in which the actuator is disposed.

8. The switch of claim 7 further comprising a flexible overlay sheet adjacent the upper spacer.

9. The switch of claim 1 wherein the armature further comprises an upstanding button that extends through the aperture into contact with the actuator.

10. The switch of claim 1 wherein the actuator is a generally rectangular sheet having first and second standoffs in contact with the coupler layer, the standoffs being located near adjacent corners of the rectangular sheet.

11. The switch of claim 10 wherein the actuator has two long edges and two short edges, the standoffs defining a line parallel to one of the long edges.

12. The switch of claim 1 wherein the armature defines a primary dimension and the actuator base portion has first and second standoffs in contact with the coupler layer, the standoffs being separated from one another a distance greater than the primary dimension of the armature.

13. The switch of claim 12 wherein the armature is circular and the primary dimension is the diameter of the armature.

14. An electrical switch, comprising:

a substrate;

a set of electrodes disposed on said substrate and defining at least one pair of spaced switch contacts;

a coupler layer supported in spaced relation to the substrate;

an electrically conductive armature disposed at least partially between the coupler layer and the substrate, the armature including a force-receiving portion and a base portion, the base portion being adjacent to the substrate and wherein the base portion includes a foot which always remains in contact with the substrate, the force-receiving portion being cantilevered from the base portion, one of the coupler layer and armature being a permanent magnet and the other being made of magnetic material such that the force-receiving portion is normally held spaced from the switch contacts in engagement with said coupler layer by the magnetic attraction between the coupler layer and force-receiving portion;

at least a portion of the force-receiving portion being disposed with respect to the coupler layer such that an actuating force can be exerted on the force-receiving portion.

15. The switch of claim 14 wherein the base portion includes a shoulder which always remains in contact with the coupler layer.

* * * * *